United States Patent [19]

Solbes et al.

[11] Patent Number: 4,920,898

[45] Date of Patent: May 1, 1990

[54] GAS TURBINE SLAGGING COMBUSTION SYSTEM

[75] Inventors: Albert Solbes, Palos Verdes Estates; Hideo Iwata, Torrance, both of Calif.

[73] Assignee: TRW Inc., Redondo Beach, Calif.

[21] Appl. No.: 319,802

[22] Filed: Mar. 7, 1989

Related U.S. Application Data

[63] Continuation of Ser. No. 246,008, Sep. 15, 1988, abandoned, which is a continuation of Ser. No. 170,048, Mar. 11, 1988, abandoned, which is a continuation of Ser. No. 97,393, Sep. 15, 1987, abandoned, which is a continuation of Ser. No. 826,950, Feb. 7, 1986, abandoned.

[51] Int. Cl.[5] ..... F23D 1/00

[52] U.S. Cl. ..... 110/265; 110/214; 110/230; 110/254; 110/264; 110/302; 110/345; 110/347

[58] Field of Search ..... 110/264, 265, 214, 230, 110/254, 347, 345, 302

[56] References Cited

U.S. PATENT DOCUMENTS

| | | | |
|---|---|---|---|
| 2,516,141 | 7/1950 | Newman et al. | 110/264 X |
| 2,971,480 | 2/1961 | Sage . | |
| 3,124,086 | 3/1964 | Sage et al. . | |
| 3,250,236 | 5/1966 | Zelinski | 110/265 |
| 3,357,383 | 12/1967 | Golovanov et al. | 110/266 |
| 3,358,624 | 12/1967 | Way | 110/260 |
| 3,540,387 | 11/1978 | McLaren et al. . | |
| 3,693,557 | 9/1972 | Makuch . | |
| 3,717,700 | 2/1973 | Robinson et al. . | |
| 3,966,431 | 6/1976 | Craig et al. . | |
| 4,022,591 | 5/1977 | Staudinger . | |
| 4,111,755 | 9/1978 | Ban et al. | 110/345 X |
| 4,147,116 | 4/1979 | Graybill | 110/263 |
| 4,217,132 | 8/1980 | Burge et al. | 75/26 |
| 4,235,585 | 11/1980 | Anderson . | |
| 4,285,283 | 8/1987 | Lyon et al. | 110/347 |
| 4,331,638 | 5/1982 | Michelfelder . | |
| 4,346,064 | 8/1982 | Leon | 110/345 X |
| 4,377,118 | 3/1983 | Sadowski | 110/343 |
| 4,381,718 | 5/1983 | Carver et al. | 110/347 |
| 4,395,975 | 8/1983 | Ashworth et al. | 110/229 X |
| 4,423,702 | 1/1984 | Ashworth et al. | 110/229 X |
| 4,424,765 | 1/1984 | Strohmeyer, Jr. | 110/263 X |
| 4,458,606 | 7/1984 | Merrell | 110/343 |
| 4,469,032 | 9/1984 | Yan | 110/347 X |
| 4,481,892 | 11/1984 | Mah | 110/263 |

(List continued on next page.)

FOREIGN PATENT DOCUMENTS 551776 3/1982 Australia .

OTHER PUBLICATIONS

Conoco Technical Bulletin, TB 1/84 BJK.

Freund et al., Combustion and Flame 45: 191–203 (1982).

Freund, Combustion Science and Technology, 1981, vol. 26, pp. 83–88.

Jensen et al., ACS Symposium Series, No. 196 Chemical Reaction Engineering–Boston, pp. 335–346, Wei et al., Editors (1982).

VGB Kraftwerkstechnik 66 (VGB Power Plant Engineering), vol. 7, Jul. 1986, pp. 637–645.

Frey, TRW Coal Combuster $NO_x$ Emissions, TRW, Inc., Mar. 25, 1987, 27 pages.

Ser. No. 79,379, filed Jul. 30, 1987, Egense and Kuenzly.

*Primary Examiner*—Edward G. Favors

*Attorney, Agent, or Firm*—Jeffrey G. Sheldon; Benjamin DeWitt

[57] ABSTRACT

There is provided a slagging combustion system for generating high purity working fluid suitable for driving gas turbines. The system consists of a precombustor for preheating oxidant tangentially fed to a primary slagging combustor where a solid carbonaceous material is combusted under substoichiometric slagging conditions. Slag is collected in the primary slagging combustor and products of combustion passed to a transition section where tertiary oxidant and sulfur-gettering agents are added, and then to a cyclonic secondary combustion chamber.

71 Claims, 5 Drawing Sheets

U.S. PATENT DOCUMENTS

| | | | |
|---|---|---|---|
| 4,498,402 | 2/1985 | Kober et al. | 110/345 |
| 4,500,281 | 2/1985 | Beardmore . | |
| 4,507,075 | 3/1985 | Buss et al. | 110/265 |
| 4,514,256 | 4/1985 | Kober et al. | 110/346 |
| 4,517,904 | 5/1985 | Penterson et al. | 110/347 X |
| 4,542,704 | 9/1985 | Brown et al. | 110/347 |
| 4,555,392 | 11/1985 | Steinberg | 110/345 X |
| 4,561,364 | 12/1985 | Green et al. | 110/261 X |
| 4,566,392 | 1/1986 | Ishihara | 110/345 X |
| 4,582,005 | 4/1986 | Brown | 110/345 X |
| 4,586,443 | 5/1986 | Burge et al. | 110/347 |
| 4,613,487 | 9/1986 | Yoon et al. | 110/345 X |
| 4,651,653 | 3/1987 | Anderson et al. | 110/347 X |
| 4,655,148 | 4/1987 | Winship | 110/347 |
| 4,660,478 | 4/1987 | Sheppard et al. | 110/264 |
| 4,685,404 | 8/1987 | Sheppard et al. | 110/265 |
| 4,800,825 | 1/1989 | Kuenzly | 110/345 |

GAS TURBINE SLAGGING COMBUSTION SYSTEM

This application is a continuation of application Ser. No. 246,008, filed Sept. 15, 1988, now abandoned; which is a continuation of application Ser. No. 170,048, filed Mar. 11, 1988, now abandoned; which is a continuation of application Ser. No. 097,393, filed Sept. 15, 1987, now abandoned; which is a continuation of application Ser. No. 826,950, filed Feb. 7, 1986, now abandoned.

BACKGROUND OF THE INVENTION

Over the past twenty years, the use of gas turbine systems has been on the increase among utilities, as well as in industry. Gas turbine systems, whether used in conjunction with steam turbines or alone, provide their users with an efficient source of energy, mechanical or electrical, at a modest capital cost. Typically, capital cost is one-half to one-third that of more conventional steam-powered plants. Other advantages associated with gas turbine systems stem from their availability at modest sizes when compared to steam turbines, the relatively fast delivery time to the user, and the flexibility that a modular approach can provide to satisfying increasing energy demands.

The working fluid for gas turbine systems is directly derived from the products of combustion of carbonaceous fuels. The highly stressed working elements (blades) of the turbine need to preserve their shape and integrity for efficient operation over protracted periods of time. In consequence, exacting requirements are usually imposed upon the fuels which can be used to generate the working fluid for such systems. Up until now, non-solid fuels, such as natural gas or oil, have been required to provide a working fluid of a purity which minimizes deposition, erosion, and corrosion of the turbine elements.

In recent years, oil prices have increased by about a factor of ten. Many electric utility and industrial plants are caught in a cost squeeze. Restriction to the use of gas or oil as the fuel for the operation of gas turbine systems, makes such systems less attractive to the user. Coal and related solid carbonaceous fuels are our most abundant reserve of fossil fuels. Accordingly, efforts are presently underway to develop systems which would make possible the use of coal in gas turbine systems. Such systems, if economical, would be very attractive to users in the utility, industrial, and transportation markets.

Two approaches aimed at using coal with gas turbine systems have received attention. The first uses a process in which coal is first gasified, and the products of gasification, after being suitably cleaned of impurities at moderate or low temperatures, are made available for use in the gas turbine system. Drawbacks of this approach are reduced efficiency and a substantial increase in capital cost associated with the gasification and clean-up processes.

The second approach relies on coal beneficiation. This approach involves removal of the major fraction of the coal impurities. Typically, a reduction of the mineral matter content to levels below one-half of one percent by weight of the coal, and comminution to sizes small enough so that, after combustion, residual ash particles will not exceed dimensions of the order of five microns, are required. Removal of a major fraction of the sulfur in the coal is also desirable to eliminate the need for back-end SOx removal equipment. This approach promises to preserve the low capital cost of existing gas turbine systems, but the high cost of chemical beneficiation of coal would result in fuel costs comparable to oil.

The present invention is directed to the resolution of the problem by a process in which clean-up of the working fluid is carried out in conjunction with its generation. With this approach, the benefits of modest capital and fuel costs are retained. The present invention utilizes a slagging combustor in combination with other equipment and operating regimes to provide a working fluid of desired purity for direct use in gas turbine systems.

Slagging combustors are described in U.S. Pat. No. 4,217,132 to Burge, et. al. and U.S. application Ser. No. 788,929 filed Oct. 18, 1985, now U.S. Pat. No. 4,685,404 which is a continuation of application Ser. No. 670,417, each assigned to the assignee of record and each incorporated herein by reference.

We have found that the aforementioned slagging combustion systems can provide the following advantages. High power density: about 1.0 million Btu/hr per cubic foot of volume and per atmosphere of pressure in the primary combustion chamber of the slagging combustor. High carbon conversion: conversion of substantially all carbon to oxides of carbon within the combustion system. Removal of non-combustibles: Capture and removal from the gaseous products of combustion of most, of the order of 95 percent, of the non-combustible mineral content of the fuel before the fluid leaves the slagging combustion system. Low NOx: Low nitrogen oxide emissions achieved by fuel and air staging for fuels naturally containing substantial amounts of nitrogen. Low SOx: Control of sulfur oxide emission by the addition of suitable gettering agents into the slagging combustion system. Thermal efficiency: Delivery to the end-use equipment of a gaseous working fluid having about 85 to 95 percent of the chemical potential energy of the carbonaceous fuel. Durability: Protection of the walls of the high temperature primary combustion chamber by a layer of slag so that deleterious corrosion and/or erosion of the walls can be kept within commercially acceptable limits.

The present invention is directed to improved apparatus utilizing a slagging combustor and a process which generates a high-purity working fluid from carbonaceous fuels, such as coal, for use in gas turbine systems.

SUMMARY OF THE INVENTION

According to the present invention, therefore, there is provided a compact apparatus and method for efficient combustion of particulate carbonaceous materials at high energy output per unit volume, removing non-combustibles to the highest levels possible, while minimizing the generation of nitrogen oxides and removing from the products of combustion a major portion of the fuel's sulfur content. All of this is accomplished prior to delivery of purified products of combustion to the end-use equipment at pressures and temperatures compatible with the operation of gas turbines.

The apparatus comprises, in combination, a slagging combustor comprising a primary combustor including means for removal and disposal of slag formed in the combustion of fuel. The primary combustor, having a head end and an opposed apertured baffle at the exit end.

communicates with a secondary chamber by tertiary oxidant injection-transition means for adding supplementary oxidant to the fluid passing to the secondary combustion chamber to complete combustion and in sufficient quantity to reduce the fluid temperature to levels compatible with the end-use equipment. Preheated oxidant for the primary combustor is generated in a precombustor positioned normal to the axis of the primary combustor and tangentially introduced to the primary combustor, along with injection of particulate carbonaceous fuel such as coal to the primary combustor. This creates a split-flow operation with fuel being combusted in flight to form combustion products comprising carbon monoxide and hydrogen with generation of slag which is collected on the walls of the primary combustor. Means of injecting suitable gettering agents for the control of sulfur and, if necessary, alkali vapor are provided in the transition means. The secondary combustor includes a cyclonic solids separation system which ensures the system will provide a working fluid for a gas turbine which is tailored, in purity and temperature, to its needs.

The apparatus is used in a process for generating a purified working fluid suitable for use in a gas turbine and the like. The process comprises forming a preheated oxidant in a precombustor zone by combusting first particulate carbonaceous material with oxidant to form first combustion products and combining in the precombustor zone the first combustion products with additional oxidant to yield preheated oxidant at a temperature of from about 1200° to about 2500° F. The preheated oxidant is tangentially introduced to a primary combustion zone hving a head end and an apertured baffle exit end simultaneously with injection of second particulate carbonaceous material into the primary combustor zone at a point between the head end and exit end in a manner to establish first and second high-velocity flows of a mixture oxidizer, particulate carbonaceous material, and combustion products with the first and second high-velocity flows proceeding respectively toward the head end and exit end of said primary combustor zone.

The oxidizer and fuel input velocities and mass-flow rates are regulated to maintain a substoichiometric combustion regime within said primary combustion zone, most of the slag content of the fuel is driven to the walls of the primary combustion zone, and substantially all of the carbon content of the fuel is converted to oxides of carbon before the gaseous products of combustion leave the primary combustion zone. Slag formed in the combustion of said carbonaceous fuel is removed from the primary combustion zone, separately from the gaseous products.

Tertiary oxidant is introduced into the combustion products in a transition zone between the exit of said primary combustion zone and a secondary combustion zone to form an oxygen-rich fluid at a temperature suited for use in end-use apparatus. Oxidizing of carbon monoxide and hydrogen and gettering sulfur oxides and any alkali metal vapor by solid getting agents occurs in said secondary combustor zone simultaneously with centrifuging and separating of solids, including gettering agents, from the oxygen-rich fluid to form a substantially solids-free working fluid which is conducted to end-use apparatus.

In operation, only the primary combustion chamber is operated under wet wall (liquid slag-coated) conditions. The secondary combustion chamber, including the centrifuging means, is operated in a temperature regime such that substantially all of the non-combustible minerals, i.e. fly ash and slag, that may be carried over from the primary combustion zone, are centrifuged out of the gaseous products and are separately removable from the system.

THE DRAWINGS

Figure 10:
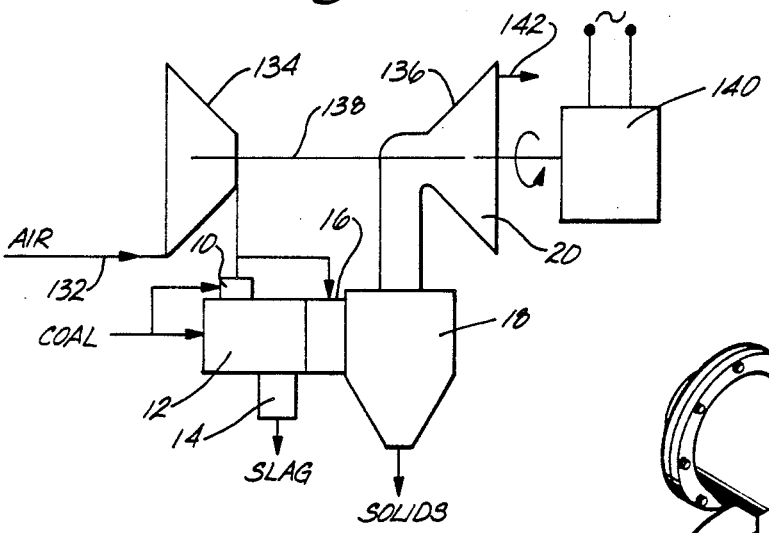
Figure 7:
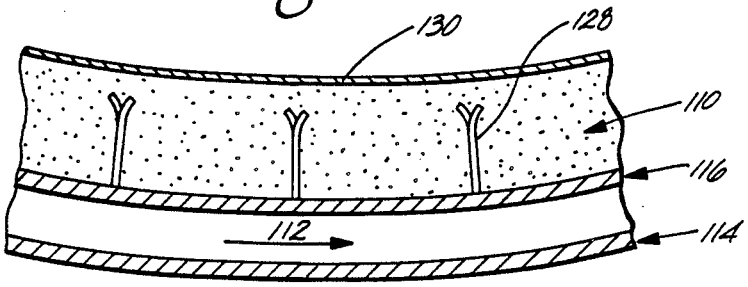
Figure 5:
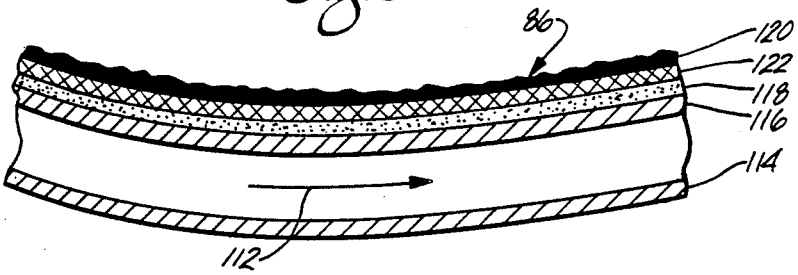
Figure 6:
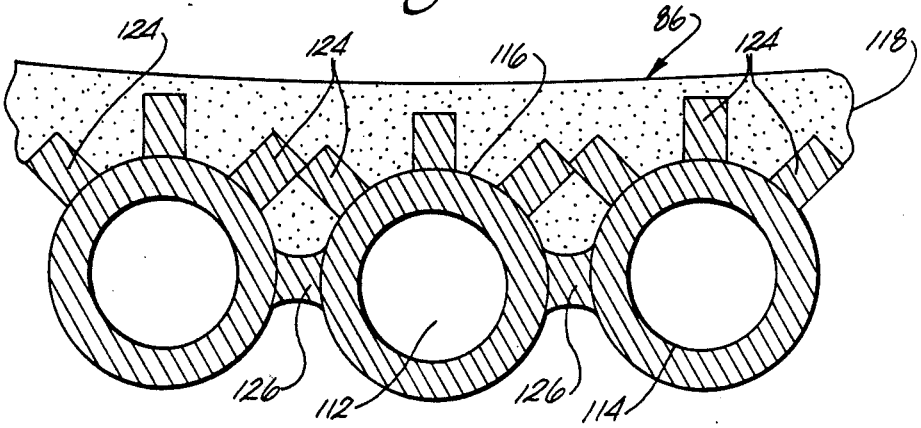
Figure 8A:
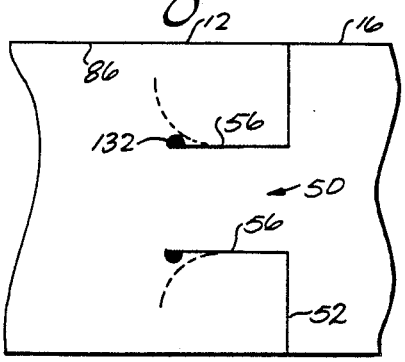
Figure 9:
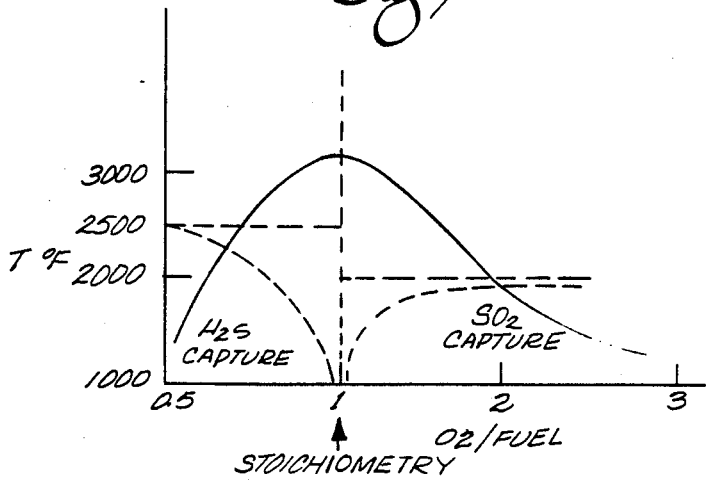

FIGS. 5, 6, and 7 illustrate slag and refractory lining systems for the primary and secondary combustors;

FIGS. 8A, B, and C illustrate several alternative baffle configurations for the primary combustor;

FIG. 9 illustrates sulfur capture as a function of stoichiometry and temperature, including the conditions utilized in the practice of the process of our invention; and FIG. 10 schematically illustrates diagramatically the apparatus of the invention in combination with a gas turbine system.

DETAILED DESCRIPTION

There is provided, in accordance with the present invention, apparatus and a method for efficiently combusting particulate carbonaceous materials and removing solid noncombustibles to the highest levels possible, while at the same time minimizing the generation of the oxides of nitrogen and providing an efficient means to remove sulfur compounds before the gaseous products are introduced into an associated system for utilizing the thermal and chemical energy of the products of combustion, or working fluid. The working fluid is provided at sufficient purity for use in a gas turbine.

Figure 1:
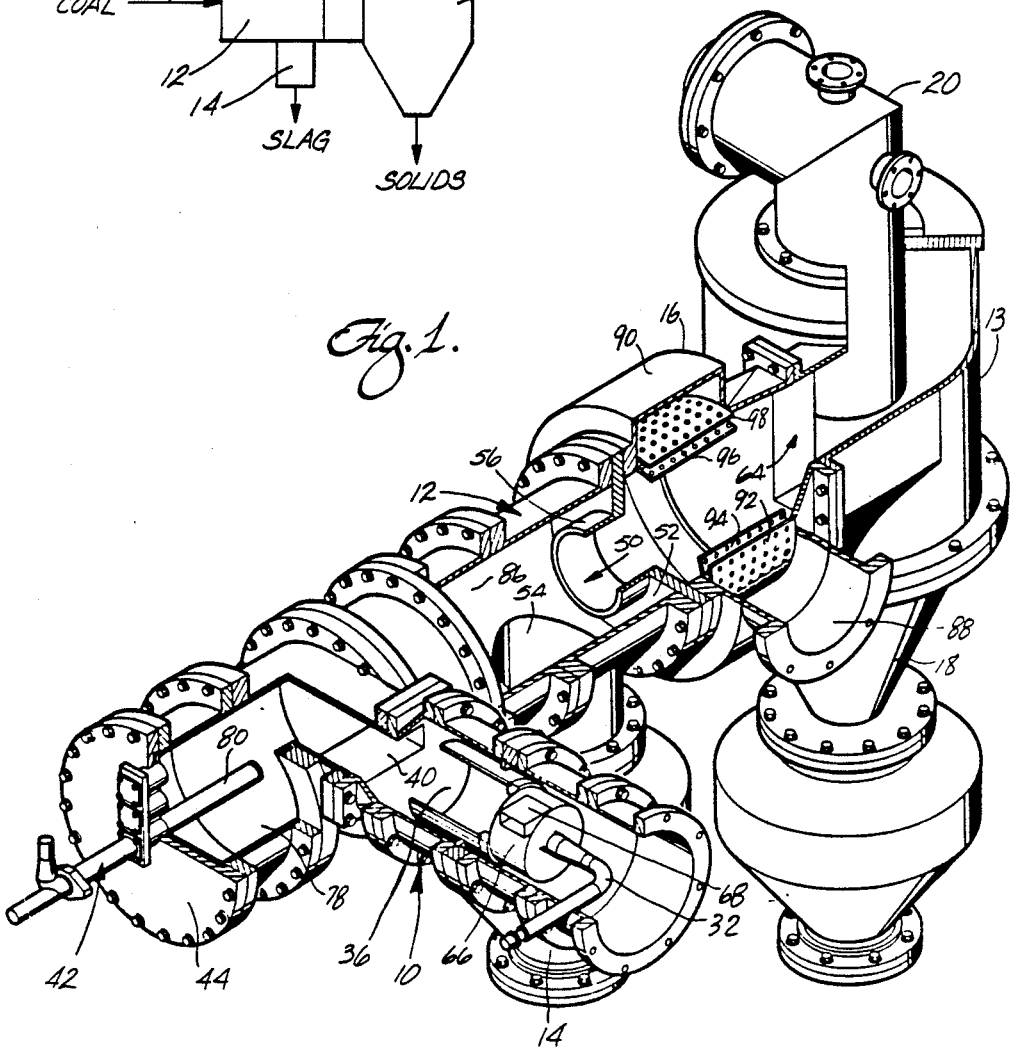
FIG. 1 is a cutaway perspective view of the apparatus for providing a high-purity working fluid for use in a gas turbine.
Figure 2:
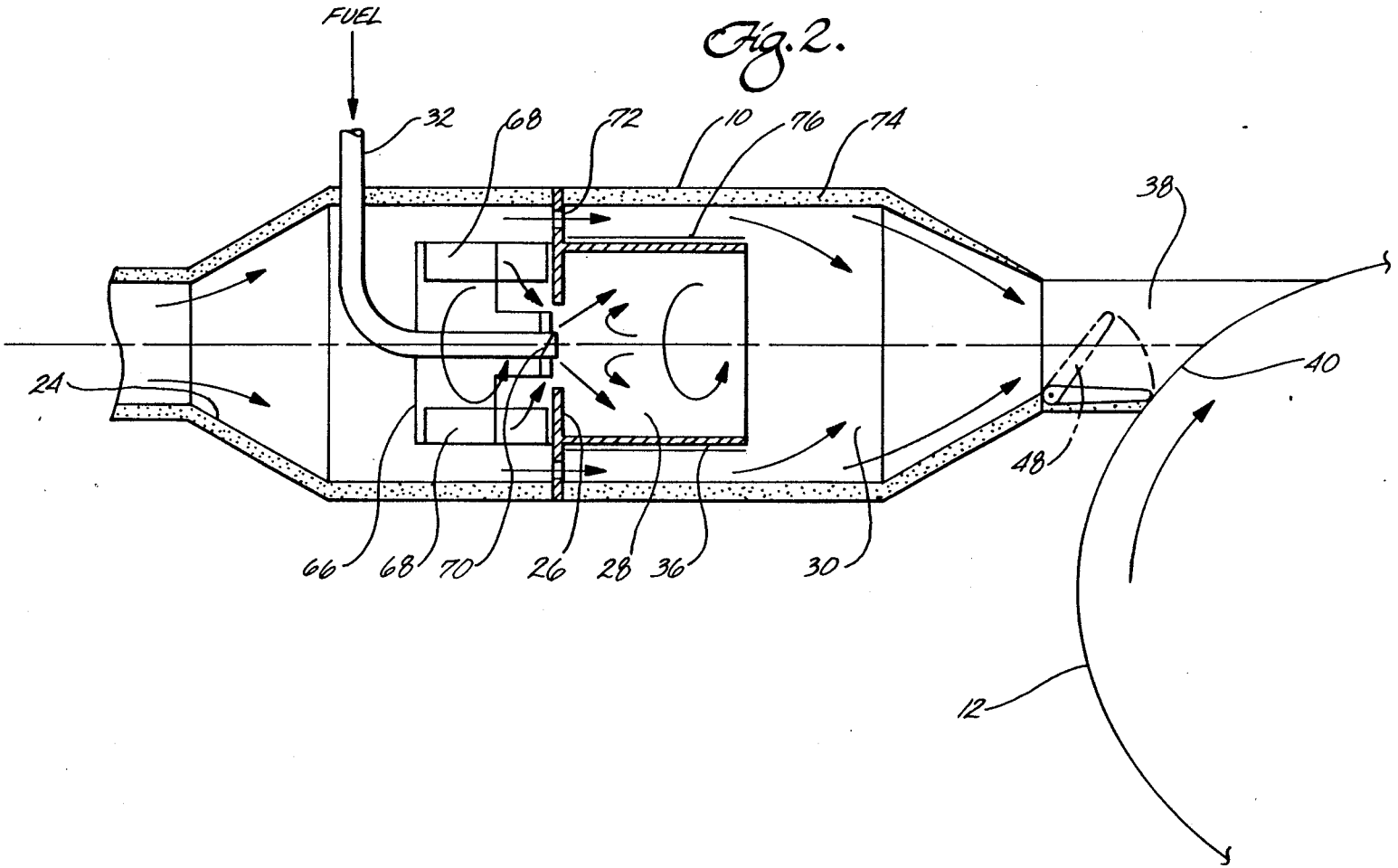
FIG. 2 is a detailed illustration of the precombustor of the apparatus of FIG. 1.
Figure 3:
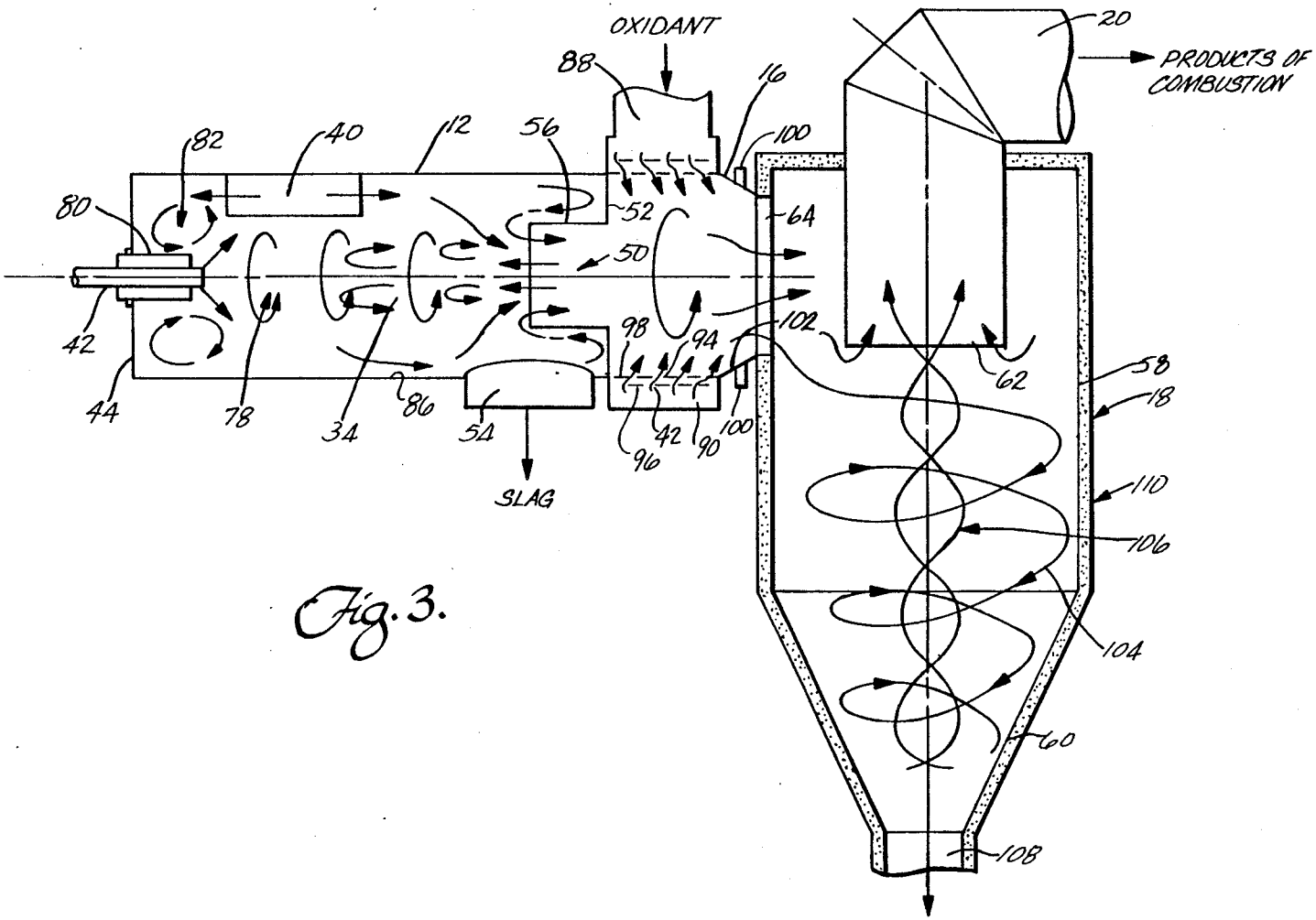
FIG. 3 is a detailed illustration of the primary combustor, tertiary oxidant injector transition section, and secondary combustor of FIG. 2.

With reference to FIGS. 1, 2, and 3, the following mechanical units are coupled together: a precombustor 10, a primary combustor 12, a slag collection unit 14, a tertiary oxidant injection transition section 16, a secondary combustor chamber 18, and an exit conduit 20. The apparatus is compact and capable of operation at pressures typical of gas turbine systems and supplying a working fluid which satisfies stringent gas turbine specifications.

By the term "particulate carbonaceous fuel" used herein, there is meant carbon-containing substances that include noncombustible minerals and which can be provided as a fuel in a dispersed state, either suspended in a gaseous carrier fluid as free particles, or as a slurry. Representative carbonaceous materials include, among others, coal, char, the organic residue of solid waste recovery operations, tarry oils that are dispersible in liquid, and the like. All that is required is that the carbonaceous material be oxidizable in the primary combustor chamber, and amenable to dispersion as discrete particles in the carrier fluid. Preferably, the fuel is powdered coal of a grind so that about 70 percent will pass through a 200-mesh screen. By the term "oxidant" there is meant air or oxygen-enriched air. By the term "carrier fluid" there is meant a gas or liquid which may be inert, or an oxidant.

With reference to FIGS. 1 and 2, the precombustor 10 comprises, first, an oxidant addition chamber defined by converging end wall 24 and a first apertured baffle 26, spaced from end wall 24. This chamber includes means for imparting a swirling motion to the first oxidant stream. A first combustion zone 28 extends along the precombustor axis, from baffle 26 to a second oxidant introduction zone 30. Nozzle means 32 is adapted to inject the carbonaceous fuel into precombustor 10. The fuel is dispersed into the zone 28 by virtue of the initial momentum provided by the nozzle and/or by the centrifugal forces which result from the swirling motion of the oxidant flow near the baffle aperture. The second oxidant introduction zone 30 starts near the exit plane of the cylindrical pre-combustion chamber 36 and terminates in a duct extending to the primary combustor 12 and is attached thereto at an opening 40, preferably rectangular, positioned to enable introduction of oxidant and products of combustion from the precombustor tangentially and adjacent to the walls of the primary combustor 12. The axis of precombustor 10 is preferably horizontally oriented.

With specific reference to FIGS. 1, 2 and 3, cylindrical primary combustor chamber 12 is normally positioned with its main axis horizontally oriented and in a direction orthogonal to that of the precombustor axis. The primary combustor 12 includes a fuel injector 42 for introduction of particulate carbonaceous material, which extends into the primary combustion chamber from the end wall 44 thereof.

With reference to FIGS. 5 and 6, primary combustion chamber 12 provides an inner wall surface 86, adapted to retain and maintain thereon a slag layer resulting from the combustion of the carbonaceous material. The oxidizer entering the primary combustor chamber effectively splits into two flows. One is directed towards the head-end 44 and fuel nozzle 42, the other is directed towards the apertured baffle exit end 52. Preferably, one or more dampers 48 are provided at the inlet 40 to the primary combustor to control the flow velocity at the inlet of the primary combustor chamber. The products of combustion leave the primary combustor chamber through the opening 50 of a second baffle 52 with a high velocity swirling motion.

An opening 54 with a vertically oriented axis is located immediately upstream of the exit baffle 52 and collects the flow of slag flowing towards the exit of the primary combustor 12. Slag flow occurs primarily as a result of the shear forces imparted by the gas motion, and of gravity forces, thus effectively removing mineral matter from the system. The primary combustor exit baffle 52 may include a cylindrical reentrant member 56 extending into the primary combustor to further hinder the flow of molten slag to the downstream components.

Products of combustion from the primary combustor 12 pass into a tertiary oxidant injection transition section 16. Tertiary oxidant is added in amounts sufficient to complete oxidation of any as-yet unburned constituents of the flow, mainly hydrogen and carbon monoxide, and to reduce the effluent temperature to a level compatible with the end-use equipment. Oxidant injection and transition section 16 is also preferably provided with means of injecting suitable gettering agents for the control of sulfur emission and/or alkali carry-over in vapor form. The gettering agents may be introduced with the tertiary oxidant flow or by separate injection nozzles. The tertiary oxidant injection and transition zone 16 extends to secondary combustor 18 and is attached thereto by an opening, preferably rectangular, positioned to enable introduction of the product mixture tangentially and adjacent to the inner wall of the secondary combustor 18.

The secondary combustor 18 is geometrically configured as a cyclone separator with a symmetry of revolution about a vertically oriented axis. It comprises a vertically oriented, cylindrical portion 58 and a conical bottom portion 60 for the removal of solid particulate matter from the system. The products of combustion exit vertically with a high swirling motion through a reentrant outlet conduit 20 having inlet 62 extending into the secondary combustion chamber to a point preferably below that of the tangential entry port 64. After exiting the secondary combustor 18, the products of combustion or working fluid are ducted by conduit 20 to the end-use equipment, typically a gas turbine.

In the presently preferred embodiment, and with reference to FIGS. 1 and 2, a fraction of the oxidant flow to the precombustor 10 enters a swirl can 66 through one or several openings 68 which impart a strong swirling motion to the fluid oxidant. This motion can also be imparted or is enhanced in the vicinity of the fuel nozzle 32 by a set of guide vanes 70 generally inclined at an angle of 45° to 60° relative to the precombustor axis. This arrangement is effective in preventing coking of the fuel nozzle and aids in dispersing the fuel within the combustion chamber 36. The fuel nozzle tip is preferably located at or near the plane of the baffle 26 which forms the back wall of combustion chamber 36. The amount of oxidant entering the combustion chamber 36 is preferably that required for stoichiometric combustion of that portion of the fuel being fed to the precombustor subassembly. The rest of the oxidizer flows outside the combustion chamber 36 through an annular opening 72, whose dimension is such that the desired partition of the oxidant is achieved. The oxidant mixes in zone 30 with the products of combustion from the combustion chamber 36 to yield a heated oxidant with a temperature in the range of 1200° to 2500° F. At the same time, a transition in the flow cross section from circular to rectangular is effected. The oxidant mixture is then injected into the primary combustor through the rectangular inlet 40. Damper 48 is used to control the oxidant injection velocity as the load dictates. Heat losses and cooling requirements are minimized by providing thermal insulation 74 for the walls of precombustor 10. This is achieved either through the use of refractories or other equivalent thermal insulation. The combustion chamber 36 is water-cooled. Thermal insulation or an uncooled annular shield 76 minimizes heat loss from the oxidant normally introduced at a temperature from about 250° to about 700° F. to the water-cooled walls of combustion chamber 36.

With reference now to FIG. 3, the primary combustor 12 extends from head end 44 to the exit end defined by apertured baffle 52. Particulate carbonaceous fuel, along with its carrier fluid, is introduced through fuel injector 42, which is preferably located on the axis of the primary combustor 12. Fuel injector 42 extends from end wall 44 to a position along primary combustor 12 such that the particulate fuel is injected in the primary combustion zone 78 at a location just upstream from the oxidizer inlet aperture 40. A slag-coated hot sleeve 80, such as described in U.S. application Ser. No. 670,417, surrounds the fuel injector 42 and promotes rapid ignition of the fuel upon entry into combustion zone 78. The oxidant and fuel flows are selected to yield a net oxygen-to-fuel mixture ratio from about 70 to about 90 percent of balanced stoichiometry. The oxidant velocity at the inlet 40 of the primary combustor 12 is from about 200 to about 400 feet per second. This, in combination with head end 44, the apertured baffle 52, results in a strong confined vortex motion characterized by high turbulent sheer rates, complex recirculation zones, such as depicted as 82 and 84, and strong centrifugation of nongaseous products. This flow field enhances mixing of the reactants and stabilizes the combustion process. The centrifugal forces drive substantially all solid and liquid noncombustibles, and any noncombusted combustibles, to the wall surfaces 86 of primary combustor 12 in the form of molten slag. Slag flows towards the baffle 52, and is collected at aperture 54 where it is removed by gravity from the primary combustor 12 to a slag collection system (not shown).

Figure 8B:
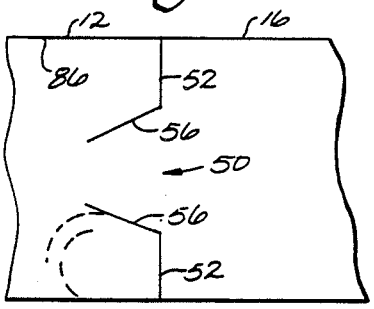

With reference to FIGS. 8A and 8B, reentrant portion 56 of baffle 52 serves to inhibit the flow of molten slag to the downstream components. Typically, the baffle aperture 50 is half the primary combustion chamber diameter, and the length-to-diameter ratio of the reentrant portion 56 of the baffle is approximately 1 to 1. This, in combination with the strong whirling motion, prevents substantially all but the smallest particles to be entrained in the gaseous fluid exiting the primary combustor 12.

Figure 4:
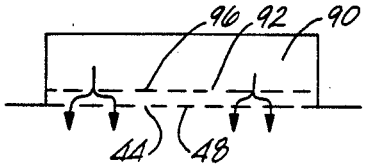
FIG. 4 is a detailed illustration of one system for injecting tertiary oxidant into products of combustion.

With additional reference to FIG. 4, upon leaving the primary combustor, the products of combustion enter tertiary oxidant injection and transition section 16, where tertiary oxidant is injected from conduit 88 to surrounding plenum 90 and through ports 92 and 94 in circular grid plates 96 and 98. The pattern of oxidant flow, as illustrated in FIG. 4, maintains the surfaces of plates 96 and 98 sufficiently cool to prevent corrosion and helps insure against burnout of sulfur or other getters introduced with the oxidant. Mixing of the two streams results in final combustion, mainly of CO and $H_2$ and oxidation of $H_2S$ to $SO_x$ with dilution to temperatures which are compatible with operation of gas turbines, typically in the vicinity of about 1500° to about 2000° F. As previously noted, selected gettering materials (sorbents) can be mixed with the tertiary oxidant prior to injection into the system. In the presently preferred embodiment, sulfur getters are introduced with the tertiary oxidant and alkali or by conduits 100 positioned about converging duct 102 forming part of opening 64 leading to secondary combustor 18. Duct 102 preferably terminates in a vertically oriented rectangular tangential opening 64 at the inlet of the secondary combustor 18. The flow in the combustion zone of secondary combustor 18 may be characterized by a helical motion with a descending outer zone 104 and an ascending inner zone 106. Residence times in the order of 200 milliseconds or more are provided for gettering of sulfur and alkali vapor species, as required. Ash, slag droplets and debris, and gettering agents are removed from the system through aperture 108. The purified products of combustion leave the system entering inlet 62 of duct 20.

With reference to FIG. 7, refractory thermal insulation 110 is provided on the internal walls of the secondary combustion chamber so as to minimize heat losses and reduce cooling requirements.

FIGS. 5, 6, and 7 illustrate preferred structures for providing thermal and corrosion protection of the walls of the primary and secondary combustors. FIG. 5 illustrates the preferred configuration for the slagging walls of the primary combustion chamber. Cooling is provided by the flow of coolant 112 at a suitable velocity inside a passage enclosed by surfaces 114 and 116. The passage may be a tube, a double-walled membrane construction, or the like. When first constructed, a suitable sacrificial refractory 118, such as Missouri Flint Clay, is placed on the hot-gas side of surface 116 in a nominal thickness of about 0.5 inch. During operation, slag deposits on the clay. The combination of liquid slag 120, frozen slag 122, and the clay 118 are of a thickness such that, when subjected to the heat flux from the combustion gases, a freely flowing fluid layer of slag will result at steady state. As time progresses, the original refractory is partially or completely replaced by the solid and liquid slag layers. The flowing slag layer 120 provides a source for curing and replenishment for any loss of thermal protection of the wall surface 118. The coolant is kept in the temperature range from about 325° to 600° F. This minimizes acidic corrosion and also guards against hydrogen sulfide corrosion. Water is preferably utilized as the coolant for the primary combustion chamber. The water can be used in the overall cycle for combined cycle systems or flashed into steam and injected into the products of combustion, thus augmenting the turbine work.

FIG. 6 illustrates the presently preferred wall construction arrangement for securely retaining refractory and/or slag. Here, the coolant passage surfaces 114 and 116 are the interior and exterior surfaces of a cylindrical metal tube. Attached by welding to surface 116 are studs 124, generally staggered along the coolant passage length. A tube-and-membrane construction is utilized for the containment walls. Each tube is joined to adjacent tubes by a full penetration weld at mid-diameter with membranes 126. This wall construction can also be used for the secondary combustor 18, studs being effective in retaining refractory of sufficient thickness so that heat losses and cooling requirements are minimized. For this application, high-porosity, alumina-based refractories, which are available as castable, concrete and ramming mixes, can be used.

FIG. 7 illustrates an alternate wall configuration for the secondary combustor 18. Here, metallic anchors 128 are used to hold the refractory 110 in place. A high-temperature metallic liner 130 can also be used to preserve the refractory integrity. The preferred cooling fluids are air and water.

The system operates at the pressure level of the available oxidant, which for gas turbine systems is generally in the range of six to fifteen atmospheres. Nominal comprised oxidant temperature ranges typically from about 250° to about 700° F. A portion of the primary oxidant stream is mixed with from about 10% to about 30% of the total particulate carbonaceous material to be fed to the system for feed to the combustion chamber 36 and is normally sufficient for stoichiometric combustion of all the fuel fed to the precombustor 10. Products of combustion chamber 36 are diluted by the secondary oxidant flow to form an oxidant-rich effluent, e.g. from about 2 to about 4 times that stoichiometry required for the precombustor 10, and is suitable for injection into primary combustor 12 and used therein as the sole, or substantially the sole, source of oxidizer for the carbonaceous fuel fed to primary combustor 12. Some oxidant may be used as the carrier fluid for particulate carbonaceous material introduced to primary combustor 10, but this is a relatively negligible amount when compared to the whole. The balance of the particulate carbonaceous material is fed by the fuel injector 42 to the primary combustor 12 and mixes with the oxidant-rich preheated effluent from precombustor 10, which is delivered at a temperature from about 1200° to about 2500° F. Combustion in the primary combustor is sub-stoichiometric with the total oxidizer fed to the primary combustor 12 being in the range from about 0.7 to about 0.9 times the stoichiometric amount that would be required for combustion of the fuel. In the primary combustor 12, combustion occurs substantially in flight with conversion of a large fraction of the noncombustibles to molten slag which, by the whirling action of flow fields within the primary combustion chamber, is centrifugally driven to the walls 86 of the primary combustor and collects thereon as a slag layer whose surface is liquid or molten. Combustion temperatures in the primary combustion zone are maintained above the ash-fusion temperature of the non-combustible mineral constituents of the fuel. In steady-state operation, slag flows towards the exit baffle 52 and is removed from the system through a slag tap opening 54.

The hot oxidant inflow from the precombustor 10 is beneficial in deterring the accumulation of frozen slag near the oxidant-inflow aperture 40. It also maintains a high temperature environment throughout the head-end 82 portion of the primary combustor 12, thereby assuring prompt and stable fuel combustion closely adjacent the fuel injector 42.

The gaseous products of combustion flow through the apertured baffle 52 into the tertiary oxidant injection transition section 16, where tertiary oxidant at operating pressure is introduced to complete oxidation of any fuel species, namely, $H_2$ and CO, and reduce by dilution the temperature of the products of combustion to levels in the vicinity of about 1500° to about 2000° F., depending on turbine specification. The addition of air can be staged so as to avoid quenching the kinetics for oxidation of carbon monoxide. Air-staging in the system also limits of the formation of the oxides of nitrogen. Sufficient tertiary oxidant is added to the products of combustion to form a working fluid and so that the temperatures in the secondary combustion zone are kept below the ash-fusion temperature of the non-combustible mineral constituents of the fuel and sufficiently low to avoid deactivation of the sulfur-gettering agents used for removing sulfur constituents of the fuel from the working fluid.

Gettering materials, i.e. sorbents for capturing sulfur and/or alkali containing compounds, can be added with the tertiary air, but can also be added immediately thereafter, to getter gaseous sulfur and alkali vapor species.

Calcium-based sorbents are preferably used for sulfur capture. Such sorbents include limestone, lime, dolomite, hydrated dolomitic lime, and the like. For alkali vapor capture, aluminosilicate-based getters are preferably used in a similar manner.

In the particularly preferred embodiment of the invention, the precombustor 10 has a length-to-diameter ratio of 1.5 to 1; the primary combustor 12 has a length-to-diameter ratio of 2.4 to 1; the baffle aperture area is approximately one-quarter of the primary combustion chamber cross sectional area; the cylindrical portion of the secondary combustor 18 has a diameter 1.5 to 2 times the primary combustor diameter and a length-to-diameter ratio of 1.5 to 2 to 1. The conical bottom portion 60 of the chamber forms a cone with half angle of the order of 30°. Exit duct diameter 108 is one-third to one-half that of the secondary combustor diameter.

As indicated, preconditioning of the oxidant is accomplished in the precombustor 10 to which all, or essentially all, the primary combustor oxidant is supplied. The primary combustor oxidant is used to combust from about 10% to about 30% of the total carbonaceous feed under dry wall, i.e. nonslagging condensing conditions, to form a first reaction product. The hot, oxidant-rich gas stream containing essentially all of the first reaction product is directed in a controlled fashion into the primary combustor 12. The oxidant-rich gas stream carries all the precombustor fuel and noncombustibles, including still-burning carbonaceous particles dispersed throughout its volume. The precombustor exit temperature may range from about 1200° to about 2500° F. Precombustor geometry provides self-sustaining combustion when air is used as the oxidant, and such air is introduced at temperatures of from about 250° to about 700° F.

The heated oxidant and reactants, generated in precombustor 10, move through a rectangular exit 40 to primary combustor 12 of cylindrical geometry. This precombustor-effluent stream is introduced essentially tangential to the interior wall 86 of the primary combustor 12. The rectangular exit 40 from precombustor 10 is sized such that the dimension parallel to the primary combustor axis is larger than the dimension perpendicular to the axis of the primary combustor. A length-to-height ratio of approximately 2.5 to 1 is preferred. Preferably, the centerline of the rectangular exit is aligned with the longitudinal axis of the precombustor and is positioned upstream from the mid-point of the primary combustor longitudinal axis, i.e. about $\frac{1}{4}$ to $\frac{1}{3}$ of the distance from the head-end 44 to apertured baffle 52.

By locating the rectangular exit 40 of the precombustor 10 in the above-described manner, the precombustor effluent causes a whirling motion to be imparted to the flow within the primary combustor 12. We have found that, by controlling the precombustor velocity to the order of 200 to 400 feet per second through the use of one or several damper plates 48 located within the rectangular exit 40 of the precombustor, satisfactory combustion can be achieved over a wide range of primary combustor fuel feed rates. The above location also causes a division of the effluent into two whirling flows of comparable magnitude, one whirling towards the head-end 44, while the other moves toward the baffle 52 at the exit of the primary combustor 12.

The major portion of the carbonaceous fuel is introduced into the primary combustor 12 through a fuel injector 42. The assembly causes the carbonaceous material to be introduced in a conical flow pattern into the whirling flow field, preferably at a point slightly upstream of the precombustor exit rectangular opening 40. The bulk of the combustibles for the fuel are consumed in flight through the heated oxidizer flow field, giving up energy in the form of heat of reaction and further heating the resultant combustion products. The particles in free flight follow generally helical flow paths towards the lateral walls and exit baffle of the primary combustor 12.

The fuel-rich gases generated in the head-end of the primary combustion chamber generally flow towards the exit baffle 52 while the whirling motion is maintained. That portion of the precombustor effluent which initially divided from the head-end flow proceeds towards the exit baffle plate 52, mixes and reacts with the fuel-rich gases to yield a stream of hot combustion products, rich in CO and $H_2$.

The particles of fuel while in flight are subjected to enhanced mass and heat transport from the turbulent whirling flow field. When most of the carbon has been consumed, the remaining particulate melts and, as it impacts the walls of the combustor, mixes with the molten slag to form a continuous self-replenishing protective layer. The slag flows in a generally helical path, under the influence of gaseous aerodynamic shear forces and of gravity forces, towards the primary combustor exit and the slag tap 54 located near the exit baffle 52. Only the very small particulates, generally smaller than 10 microns in diameter, escape the chamber with the effluent gas as they are weakly centrifuged by virtue of their increased drag in relationship to their mass.

Figure 8C:
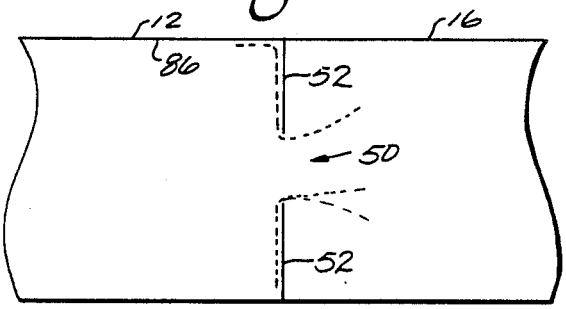

With reference to FIGS. 8A, B, and C, there are shown three functional constructions for the baffle exit. FIG. 8A utilizes lip 132 at the end of cylindrical section 56 preferably attached to baffle plate 52. This directs slag which flares off back to cylindrical inner wall 86 of primary combustor 12, instead of slag passing through port 50 into section 16. The construction of FIG. 8B may also use a lip, but has a divergent conical configuration for unit 56 to aid recapture of pressure through gas deceleration in passing through opening 50. FIG. 8C is the simplest and eliminates unit 56. Any lost slag showers into transition zone 16 and nominally hardens before striking and sticking to a surface.

Slag also flows along the exterior surface 80 of the fuel injector 42, from the head-end 44 towards the point of injection of the fuel. This very hot (molten slag) exterior surface on the injector assembly functions as a flame holder to assure stable ignition of the fuel particles as they leave the injector. In operation, the flowing slag along the injector strips off short of the point of solid particle injection, and provides small-point centers of intense radiation and ignition of the head-end-generated fuel-rich gases.

The slag tap 54 preferably is a circular opening at the bottom of the primary combustion chamber, located near the upstream side of baffle 52. This opening intercepts the flow of slag flowing along the combustor walls 86 and is used to efficiently remove slag from the system. Baffle 52 also acts as a dam which curbs the flow of slag out from the primary chamber 12 and, by its proximity to the slag tap, alone or in combination with reentrant member 56, increases slag collection effectiveness.

When burning 200-mesh coal, up to about 90 percent or more of the noncombustible content of the coal can be captured as slag and removed from the system. The balance of the mineral matter leaves the primary combustor 12 with the combustion gases, either as fluid-borne particulates of very small sizes, less than 10 micron diameter typically, or as liquid slag sheared along the inner rim of the baffle assembly by aerodynamic forces. In order to prevent the potential problem associated with freezing of a wall slag layer in the tertiary oxidant injection and transition section 16 located immediately downstream of baffle 52, it is preferable to provide for a smooth, well-cooled, inner baffle surface, so that the liquid slag layer will become detached from the walls and will form small, frozen, air-borne slag droplets.

The products of combustion leaving the primary combustion chamber enter oxidant injection and transition chamber 16. The flow cross section in that chamber changes from circular, with a diameter comparable in magnitude to that of the primary combustion chamber, to rectangular, with an exit aspect ratio of about 2.5 to 1. Preferably, the longer axis of said rectangular opening is oriented in a vertical direction.

In the preferred embodiment, and with reference to FIG. 4, the tertiary air is injected in an axisymmetric fashion from low velocity plenum 90, radially into the effluent from the primary combustor, as discreet jets or sheets through ports 92 and 94 into the fluid-exiting opening 50. Rapid mixing, followed by oxidation of the primary combustor effluent and cooling down to temperatures suitable for use in gas turbines, takes place in the oxidant injection and transition section 16 and in the secondary combustor 18. Finely-divided getters for sulfur oxides are preferably mixed with the tertiary air prior to injection into the system. When exposed to the high-temperature environment of the combustion gases, calcium carbonate will calcine to yield calcium oxide, and a highly divided surface and porous structure will result which is beneficial to capturing sulfur oxides. In the case of lime, the calcination step is not necessary. Mixing of the sorbent with the relatively cold tertiary air avoids exposure to high temperatures and the ensuing dead-burning which, if occurs, greatly reduces the specific surface area available for sulfation. Dead-burning can be further avoided by delaying the injection of the sorbent in relationship to that of the tertiary air. Preheating of the tertiary air is not required. Rather, it may be fed to the transition section plenum 90, from the compressor 134 (FIG. 10) of a gas turbine, at a mass flow rate, relative to the stoichiometry of the first combustion zone, selected to provide optimum temperatures in the secondary chamber for sulfur capture without significant dead burn of the sulfur sorbent. Injection of the sorbent near the inlet to the secondary combustor 18 also avoids exposure to the high temperatures of the effluent of the primary combustor 12.

With reference to FIG. 9, the oxidant injection and transition section 16 and secondary combustor 18 provide a gas media of the region of $SO_2$ capture, where reaction of the sulfur oxides such as:

$$SO_2 + CaO + \tfrac{1}{2}O_2 \rightarrow CaSO_4$$

are favored without the generation of oxides of nitrogen, still keeping the object of combusting to extinction of substantially all hydrogen and carbon monoxide.

Gettering agents for the alkali metal (sodium and potassium) vapors can be introduced into the system in a similar way. Suitable sorbents include active alumina, bauxite, silicate compounds, and the like.

The mixture consisting of the primary combustor exhaust gases, airborne particulates from the carbonaceous fuel, slag droplets sheared away by the gases at primary combustion chamber baffle rim, tertiary air, and particulate sorbent material is injected tangentially into the secondary chamber 18 at velocities of from about 200 to about 400 feet per second. The secondary chamber functions as a cyclone separator with flow at the periphery having a helically downward motion which effectively transports the particulate matter towards the removal point at the apex of the conical section. Flow near the axis of the chamber, by contrast, is upwards and leaves the chamber with a strong whirling motion through a centrally located reentrant pipe. The reentrant exhaust pipe 20, extending to a point preferably below the rectangular inlet 64 into the secondary combustor 18, also minimizes the amount of particulate matter which could directly escape the system. If desired, a conical exhaust pipe can be used here to reduce system pressure drop. The secondary combustor is also effective in capturing and removing any large debris and/or pieces of slag detached from the walls of the primary combustion chamber.

The exit duct 20 diameter is one-third to one-half that of the cylindrical section of the secondary combustor 18.

The products of combustion or working fluid leaving the system contain a very small amount of inert solid particles.

As an example, initially selecting a coal with an ash content of 5 percent by weight, and in the case where only 3 percent of the solids escapes the system, the particulate loading in the exhaust is only approximately 50 parts per million by weight at 15 percent excess $O_2$. Furthermore, the median size for particles will be in the range of 1 to 2 microns, with a negligibly small amount larger than 10 microns in size. This is equivalent to the carryover that one would achieve using a micronized coal with an ash content of 0.15 percent. Furthermore, assuming that by washing, a sulfur removal from the coal in the range of 25 to 50 percent is obtained, then for a sulfur removal in the range of 60 to 80 percent in the combustion system, overall sulfur reduction levels in the range 70 to 90 percent will be achieved without resorting to any back-end clean-up. Staging will also minimize the formation of nitrogen oxides with levels of the order of 100 parts per million at 15 percent excess $O_2$ or lower being achievable.

FIG. 10 illustrates the apparatus of this invention as part of a turbine operating system. With reference thereto, air is fed by line 132 to compressor 134 driven by turbine expander 136 through shaft 138. Turbine 136 also does useful work such as powering generator 140 to generate electricity. The compressed oxidant is fed to precombustor 10 and tertiary oxidant-transition unit 16 and becomes part of a working fluid. Combustion is completed and sulfur oxides and/or alkali vapor gettered in cyclone secondary combustor 18 and the highly pure working fluid fed to expander 136 where mechanical energy is generated and spent fluid exhausted by line 142.

While we have shown and described a specific embodiment of our invention, it is to be understood that various modifications may be made therein without departing from our invention; and it is, therefore, our intent to cover all changes and modifications as fall within the true spirit and scope of our invention.

What is claimed is:

1. In an apparatus for combustion of carbonaceous fuel wherein preheated oxidizer gas and particulate fuel are introduced into a substantially cylindrical primary combustor having a head end and an exit end, and wherein the flow velocities, mass flow rates, and combustion temperatures are regulated to minimize the concentration of volatized and liquid slag in the output gaseous products of combustion, and wherein the walls of the combustion chamber are maintained within a temperature range such that a layer of solidified slag is retained on the inside surfaces of the walls, the improvement comprising:

(a) means including a precombustor for preheating said oxidizer gas and introducing the preheated oxidizer gas into said primary combustor in a manner to establish first and second high-velocity flow of a mixture comprising oxidizer and combustion products with said first and second high-velocity flows proceeding respectively toward the head end and the exit end of said primary combustor;

(b) means for injecting said particulate fuel into said primary combustor near the center of the head end in a pattern such that substantially all of the fuel particles are intercepted by said flow and at least partially oxidized before reaching the walls of the primary combustor;

(c) means for regulating the oxidizer and fuel input velocities and mass-flow rates so that a substoichiometric combustion regime is maintained within said primary combustor, substantially all the slag content of the fuel is driven to the walls of the primary combustor, and substantially all of the fuel is converted to oxides of carbon and hydrogen before the gaseous products of combustion leave the exit end of said primary combustor;

(d) slag recovery means coupled to said primary combustor and adapted to receive slag formed in the combustion of said carbonaceous fuel to yield said combustion products;

(e) tertiary oxidant injection-transition means positioned between the exit of said primary combustor and a secondary combustor, said tertiary oxidant injection-transition means adapted to introduce a flow of at least oxidant into said combustion products to form an oxygen-rich fluid at a temperature suitable for use by end-use apparatus;

(f) secondary combustor means adapted to complete oxidation of carbon monoxide and hydrogen contained in the oxygen-rich fluid and separation of solids from the oxygen-rich fluid to form a substantially solids-free working fluid; and (g) means to conduct said substantially solids-free working fluid to said end-use apparatus.

2. Apparatus as claimed in claim 1 in which the tertiary oxidant injection-transition means include means for injecting getting agents for sulfur oxides and/or alkali metal vapor into said combustion products.

3. Apparatus as claimed in claim 2 in which means for injecting getter agents is positioned to follow introduction of the tertiary oxidant to the combustion products.

4. Apparatus as claimed in claim 1 in which the stoichiometry of combustion in said precombustor is controllable independently of the velocity and mass-flow rate of the products flowing from the precombustor to the primary combustor.

5. Apparatus as claimed in claim 1 in which the temperature of the products flowing from the precombustor are regulated by operation of the precombustor to within the range from about 1200° F. to about 2500° F.

6. Apparatus as claimed in claim 1 in which said precombustor comprises a substantially cylindrical combustion chamber having a head end and an exit end, a fuel injector positioned approximate the center of the head end for introducing particulate fuel into said combustion chamber in a pattern diverging toward the cylindrical walls of said chamber, and means for introducing oxidant into said combustion chamber and flowing oxidant about said combustion chamber so that substantially stoichiometric oxidation occurs in the combustion chamber and formed combustion products are combined with oxidant flowing about the combustion chamber to yield a heated oxidant stream for feed to said primary combustor.

7. Apparatus as claimed in claim 1 in which the exit end comprises an apertured baffle, and wherein the apertured baffle includes an elongate reentrant member extending from the periphery of the apertured baffle towards the head end to minimize slag lost to the combustion products.

8. Apparatus as claimed in claim 1 wherein said preheated oxidizer gas is introduced in the form of a stream of air mixed with combustion products, said stream having a temperature within the range from about 1200° F. to about 2500° F., and wherein said means for injecting particulate fuel includes means for introducing said fuel as a flow of solid particles suspended in a carrier fluid, and means for regulating the weight-to-weight ratio of said fuel to said oxidizer gas, thereby regulating combustion within the primary combustor in a manner to maintain the temperature there in substantially at a temperature exceeding 2000° F. and at a net oxidant-to-fuel stoichiometric ratio of about 0.7 to about 0.9.

9. A coal combustion system comprising:

(a) a primary combustor having a cylindrical inner wall coupled to a head end and an apertured baffle exit end opposed to the head end;

(b) means for introducing particulate comminuted coal into said primary combustor extending from near the center of the head end into the primary combustor to a point between the head end and exit end;

(c) means for tangentially injecting preheated gaseous oxidizer into said primary combustor along the cylindrical inner wall and between said head end and said exit end, said means further positioned in a manner such that a gaseous oxidizer flow is split with a portion proceeding towards said head end and a portion proceeding towards said exit end, said primary combustor enabling substantially complete substoichiometric conversion of the carbon content of the coal to oxides of carbon, including carbon monoxide to form a working fluid comprising carbon monoxide and hydrogen;

(d) a slag recovery means coupled to said primary combustor and adapted to receive liquid slag generated in the combustion of coal;

(e) means including a precombustor for generating said preheated oxidizer gas for tangential introduction into said primary combustor, said precombustor comprising means to combust coal under substantially stoichiometric conditions followed by combining the products of coal combustion with additional oxidant to yield the preheated gaseous oxidizer containing the oxidant required for combustion of the coal introduced by said means for introducing particulate coal to the primary combustor;

(f) tertiary oxidant injection means, positioned downstream of the apertured baffle exit end of said primary combustor, for adding tertiary oxidant to said combustion products to form a working fluid at a selected temperature suitable for use by an end-use apparatus;

(g) secondary combustion means adapted to complete oxidation of carbon monoxide and hydrogen contained in the working fluid and achieve cyclonic separation of solids from the working fluid to form a substantially solids-free working fluid; and (h) means to conduct said substantially solids-free working fluid to said end-use apparatus.

10. A coal-fired gas turbine system which comprises:

(a) an air compressor coupled to and adapted to be driven by a working fluid expander;

(b) a precombustor coupled to receive compressed air from the compressor and introduce preheated compressed air to a primary combustor in a manner to establish first and second high-velocity flow of a mixture comprising oxidize and combustion products with said first and second high-velocity flows proceeding respectively toward a head end and apertured baffle exit end of said primary combustor, the combustion of particulate coal with preheated compressed air yielding gaseous combustion products comprising carbon monoxide and molten slag;

(c) means for injecting particulate coal into said primary combustor proximate the center of the head end in a pattern such that substantially all of the fuel particles are intercepted by said flows and at least partially oxidized before reaching the walls of the primary combustor;

(d) means for regulating the oxidizer and fuel input velocities and mass-flow rates so that a substoichiometric combustion regime is maintained within said primary combustor, substantially all the slag content of the fuel is driven to the walls of the primary combustor, and substantially all of the fuel is converted to oxides of carbon before the gaseous products of combustion leave the primary combustor;

(e) slag recovery means coupled to said primary combustor to receive substantially all of the slag formed in the combustion of said carbonaceous fuel;

(f) tertiary oxidant injection means positioned between the exit of said primary combustor and a secondary combustor, said tertiary oxidant injection means adapted to inject a flow of compressed air from said compressor into said combustion products to form a working fluid at a temperature selected for use in said expander, said tertiary oxidant injection means including means for adding gettering agents to said combustion products;

(g) cyclonic secondary combustor means adapted to complete oxidation of carbon monoxide and hydrogen contained in the working fluid and separation of solids from the fluid to form a substantially solids-free working fluid; and (h) means to conduct said substantially solids-free working fluid to said expander apparatus.

11. Apparatus as claimed in claim 10 which additionally includes means for injecting gettering agents positioned to follow injection of the compressed air to the combustion products.

12. A process for generating a purified working fluid suitable for use in a gas turbine which comprises:

(a) forming a preheated oxidant in a precombustion zone by combusting first particulate carbonaceous material with oxidant to form first combustion products and combining in the precombustion zone the first combustion products with additional oxidant to yield preheated oxidant at a temperature of from about 1200° to about 2500° F.;

(b) tangentially introducing the preheated oxidant into a primary combustion zone having a head end and an exit end simultaneously with injection of second particulate carbonaceous material into said primary combustion zone at a point between the head end and exit end in a manner to establish first and second high-velocity flows comprising oxidizer, particulate carbonaceous material, and combustion products with said first and second high-velocity flows proceeding respectively toward the head end and exit end of said primary combustion zone;

(c) regulating the oxidizer and fuel input velocities and mass-flow rates to maintain a substoichiometric combustion regime within said primary combustion zone, wherein substantially all the slag content of the fuel is driven to the walls of the primary combustor zone, and substantially all of the carbon content of the fuel is converted to oxides of carbon before the gaseous products of combustion leave the said primary combustion zone;

(d) removing from the primary combustion zone slag formed in the combustion of said carbonaceous fuel to yield a flow of fuel-rich combustion products from which substantively all of the non-combustible mineral constituents of the fuel have been removed;

(e) introducing tertiary oxidant into a transition zone between the exit of said primary combustion zone and a secondary combustion zone to mix with said flow of combustion products and reduce the temperature of said flow to form a working fluid;

(f) oxidizing carbon monoxide and hydrogen and gettering sulfur constituents of the fuel by solid getting agents in said secondary combustion zone while centrifuging and separating solids, including gettering agents, from the working fluid to form a substantially solids-free working fluid; and (g) conducting said substantially solids-free working fluid to said gas turbine.

13. A process as claimed in claim 12 in which preheated oxidant introduced to said primary combustor zone contains oxidant in an amount of from about 2 to about 4 times the oxidant required to stoichiometrically combust the carbonaceous fuel fed to the precombustor zone.

14. A process as claimed in claim 12 in which from about 10 to about 30% of the particulate carbonaceous fuel is combusted in the precombustor zone.

15. A process as claimed in claim 12 in which oxidant is introduced to the precombustor zone at a temperature of from about 250° to about 700° F.

16. A process as claimed in claim 12 in which the tertiary oxidant is introduced into the combustion products in an amount sufficient to reduce gas temperature to a temperature of from about 1500° to about 2000° F.

17. A process as claimed in claim 16 in which tertiary oxidant introduction is staged.

18. A process as claimed in claim 16 in which gettering agents for sulfur oxides are introduced with the tertiary air.

19. A process as claimed in claim 17 in which gettering agents for sulfur oxides are introduced with the last stage of staged oxidant introduction.

20. A process as claimed in claim 16 in which the gettering agents for alkali metal vapor are introduced after introduction of tertiary oxidant.

21. A process as claimed in claim 12 in which the process is operated at a pressure of from about 5 to about 20 atmospheres.

22. A process as claimed in claim 12 in which combustion temperatures in the primary combustion zone are maintained above the ash-fusion temperature of the non-combustible mineral constituents of the fuel and sufficient tertiary oxidant is added to the products of combustion to form a working fluid so that temperatures in the secondary combustion zone are kept below said ash-fusion temperature and sufficiently low to avoid deactivation of the sulfur-gettering agents used for removing sulfur constituents of the fuel from the working fluid.

23. A process for operation in a gas turbine which comprises:

(a) compressing air to a pressure of from about 5 to about 20 atmospheres;

(b) forming a preheated oxidant in a precombustion zone by combusting first particulate coal with compressed air to form first combustion products and combining in the precombustion zone the first combustion products with additional compressed air to yield preheated compressed air at a temperature of from about 1200° to about 2500° F.;

(c) tangentially introducing the preheated compressed air into a primary combustor zone having a head end and an apertured baffle exit end simultaneously with injection of second particulate coal into said primary combustor zone at a point between the head end and exit end in a manner to establish first and second high-velocity flows comprising compressed air, particulate coal, and combustion products with said first and second high-velocity flows proceeding respectively toward the head end and exit end of said primary combustor;

(d) regulating the air and fuel input velocities and mass-flow rates to maintain a substoichiometric combustion regime within said primary combustor zone, and wherein substantially all the slag content of the coal is driven to the walls of the primary combustor zone, and substantially all of the coal is converted to oxides of carbon and hydrogen before gaseous products of combustion leave the exit end of said primary combustor zone;

(e) removing from the primary combustor zone slag formed in the combustion of said coal to yield said combustion products;

(f) introducing tertiary compressed air from the compressor and gettering agents for sulfur oxide and alkali metal vapor into a transition zone between the exit of said primary combustor zone and a secondary combustor zone to form an oxygen-rich fluid at a temperature of from about 1500° to about 2000° F. for use in an expander of a turbine;

(g) oxidizing carbon monoxide and hydrogen and gettering sulfur oxides and any alkali vapor by solid getting agents in said secondary combustor zone while centrifuging and separating solids, including gettering agents, from the oxygen-rich fluid to form a substantially solids-free working fluid; and (h) conducting said substantially solids-free working fluid to said expander.

24. A process as claimed in claim 23 in which preheated compressed air is introduced to said primary combustor zone contains air in an amount of from about 2 to about 4 times that required to stoichiometrically combust the coal fed to the precombustor zone.

25. A process as claimed in claim 23 in which from about 10 to about 30% of the particulate carbonaceous fuel is combusted in the precombustor.

26. A process as claimed in claim 23 in which compressed air is introduced to the precombustor at a temperature of from about 250° to about 700° F.

27. A process as claimed in claim 23 in which tertiary air introduction is staged.

28. A process as claimed in claim 23 in which gettering agents for sulfur oxides are introduced with the tertiary air.

29. A process as claimed in claim 23 in which the gettering agents for alkali metal vapor are introduced after introduction of tertiary air.

30. A coal combustion system comprising:

(a) a primary combustor having a head end and an apertured baffle exit end;

(b) means for introducing particulate comminuted coal into said primary combustor near the center of the head end and at a point between the head end and exit end;

(c) means for tangentially injecting preheated gaseous oxidizer into said primary combustor between said head end and said exit end, said means positioned in a manner such that a gaseous oxidizer flow is split with a portion proceeding towards said head end and a portion proceeding towards said exit end, said primary combustor enabling substantially complete substoichiometric conversion of the carbon content of the coal to oxides of carbon, including carbon monoxide;

(d) a slag recovery means coupled to said primary combustor and adapted to receive liquid slag generated in the combustion of coal;

(e) means including a precombustor for generating said preheated oxidizer gas for introduction into said primary combustor, comprising means to combust coal under substantially stoichiometric conditions followed by combining the products of coal combustion with additional oxidant to yield the preheated gaseous oxidizer containing the oxidant required for combustion of the coal introduced to the primary combustor;

(f) tertiary oxidant injection means, positioned downstream of the exit end of said primary combustor, for adding tertiary oxidant to said combustion products to form a working fluid at a selected temperatures suitable for use by an end-use apparatus;

(g) secondary combustor means adapted to complete oxidation of carbon monoxide and hydrogen contained in the working fluid and achieve cyclonic separation of solids from the fluid to form a substantially solids-free working fluid; and (h) means to conduct said substantially solids-free working fluid to said end-use apparatus.

31. Apparatus as claimed in claim 30 in which the tertiary oxidant injection means include means for injecting getting agents for sulfur oxides and alkali metal vapor into said combustion products.

32. Apparatus as claimed in claim 31 in which means for injecting gettering agents is positioned to follow introduction of the tertiary oxidant to the plenum.

33. A coal combustion system comprising:

(a) a primary combustor having a head end and an aperture baffle exit end, which aperture includes an elongate reentrant member extending from the periphery of the aperture towards the head end to minimize slag loss to the combustion products;

(b) means for introducing particulate comminuted coal into said primary combustor near the center of the head end and at a point between the head end and exit end;

(c) means for tangentially injecting preheated gaseous oxidizer into said primary combustor between said head end and said exit end, said means positioned in a manner such that a gaseous oxidizer flow is split with a portion proceeding towards said head end and a portion proceeding towards said exit end, said primary combustor enabling substantially complete substoichiometric conversion of the carbon content of the coal to oxides of carbon, including carbon monoxide;

(d) a slag recovery means coupled to said primary combustor and adapted to receive liquid slag generated in the combustion of coal;

(e) means including a precombustor for generating said preheated oxidizer gas for introduction into said primary combustor, comprising means to combust coal under substantially stoichiometric conditions followed by combining the products of coal combustion with additional oxidant to yield the preheated gaseous oxidizer containing the oxidant required for combustion of the coal introduction to the primary combustor;

(f) tertiary oxidant injection means, positioned downstream of the exit end of said primary combustor, for adding tertiary oxidant to said combustion products to form a working fluid at a selected temperature suitable for use by an end-use apparatus; said tertiary oxidant injection means comprising a plenum comprising a first ported cylindrical surface and a second ported cylindrical surface annularly spaced from the first ported cylindrical surface, the ports of the first and second ported surfaces being positioned such that tertiary oxidant passing through a port of the first ported cylindrical surface must pass along a portion of the surface of the second period cylindrical surface before exiting a port thereof;

(g) secondary combustor means adapted to complete oxidation of carbon monoxide and hydrogen contained in the working fluid and achieve cyclonic separation of solids from the fluid to form a substantially solids-free working fluid; and (h) means to conduct said substantially solids-free working fluid to said end-use apparatus.

34. A coal combustion system comprising:

(a) a primary combustor having a head end and an apertured baffle exit end;

(b) means for introducing particulate comminuted coal into said primary combustor near the center of the head end and at a point between the head end and exit end;

(c) means for tangentially injecting preheated gaseous oxidizer into said primary combustor between said head end and said exit end, said means positioned in a manner such that a gaseous oxidizer flow is split with a portion proceeding towards said head end and a portion proceeding towards said exit end, said primary combustion enabling substantially complete substoichiometric conversion of the carbon content of the coal to oxides of carbon, including carbon monoxide;

(d) a slag recovery means coupled to said primary combustor and adapted to receive liquid slag generated in the combustion of coal;

(e) means including a precombustor for generating said preheated oxidizer gas for introduction into said primary combustor, comprising means to combust coal under substantially stoichiometric conditions followed by combining the products of coal combustion with additional oxidant to yield the preheated gaseous oxidizer containing the oxidant required for combustion of the coal introduced to the primary combustor;

(f) tertiary oxidant injection means, positioned downstream of the exit end of said primary combustor, for adding tertiary oxidant to said combustion products to form a working fluid at a selected temperature suitable for use by an end-use apparatus;

(g) secondary combustor means adapted to complete oxidation of carbon monoxide and hydrogen contained in the working fluid comprising a vertically oriented upper cylindrical section and a converging conical lower section and a reentrant conduit having an opening vertically extending into the upper cylindrical section zone of said secondary combustor and in which the secondary combustor is coupled to said tertiary oxidant injection-transition means by means adapted to tangentially introduce the working fluid tangential to the vertically oriented cylindrical section at a point above the opening of the reentrant conduit, whereby there is formed a downward centrifugal flow of working fluid toward said conical section with separation of solids from the working fluid and formation of an upward flow of resultant substantially solids-free working fluid towards said opening of the reentrant conduit; and (h) means to conduct said substantially solids-free working fluid to said end-use apparatus.

35. The apparatus of claim 9 wherein the tertiary oxidant injection means further comprises means for injecting gettering agents into the combustion products.

36. The apparatus of claim 35 wherein the gettering agents injection means is a sulfur gettering agent injection means.

37. The apparatus of claim 9 further comprising means for injecting gettering agents, the gettering agent injection means being positioned downstream of the exit end of the primary combustor.

38. A process for generating a working fluid suitable for use in end use equipment by combusting a carbonaceous fuel comprising carbon, sulfur, and non-combustible mineral constituents, the process comprising the steps of:

(a) introducing the fuel into a primary combustion zone;

(b) introducing an oxidant into the primary combustion zone;

(c) combusting the fuel in the presence of the oxidant in the primary combustion zone under substoichiometric conditions at temperatures above the ash-fusion temperature of the non-combustible material constituents of the fuel to form liquid slag and gaseous combustions products comprising sulfur and oxides of carbon wherein most of the carbon content of the fuel is converted to oxides of carbon before the gaseous combustion products leave the primary combustion zone, and most of the liquid slag is driven to the walls of the primary combustion zone;

(d) removing liquid slag from the primary combustion zone;

(e) passing the gaseous combustion products through a transition zone;

(f) forming a working fluid from the gaseous combustion products by (i) introducing additional oxidant into the transition zone for reducing the temperature of the gaseous combustion products to below the ash-fusion temperature of the fuel and for further combusting the gaseous combustion products, and (ii) introducing a sorbent for sulfur into the transition zone to enable a substantial reduction in the sulfur content of the gaseous combustion products;

(g) separating solids from the working fluid to form a substantially solids-free working fluid; and (h) conducting the substantially solids-free working fluid to the end-use equipment.

39. The process of claim 38 wherein the sulfur content of the working fluid is 70 to 90 percent less than the sulfur content of the gaseous combustion products.

40. The process of claim 38 wherein the carbonaceous fuel is combusted in the primary combustion zone at a stoichiometry of about 70 to about 90 percent.

41. The process of claim 38 wherein the oxidant introduced into the primary combustion zone is preheated and the step of introducing the oxidant into the primary combustion zone includes the step of combusting a portion of the carbonaceous fuel with the oxidant in a precombustion zone to form the preheated oxidant.

42. The process of claim 38 wherein the step of removing solids comprises cyclonically separating substantially all of the solid particles from the working fluid.

43. The process of claim 38 wherein the carbonaceous fuel is combusted at a pressure greater than one atmosphere.

44. The process of claim 38 wherein the gaseous combustion products are tangentially introduced into the secondary combustion zone.

45. The process of claim 38 wherein the primary combustion zone comprises a head end and an exit end connected by the peripheral wall, and the oxidant introduced into the primary combustion zone is preheated and introduced into the primary combustion zone along the wall and between the head end and the exit end, the process further comprising the step of splitting a flow of the preheated oxidant with a portion proceeding towards the head end and a portion proceeding towards the exit end.

46. The process of claim 38 wherein the primary combustion zone is operated under liquid slag-coated wet wall conditions.

47. A process for generating a purified working fluid suitable for use in a gas turbine by combusting a carbonaceous fuel comprising carbon, sulfur, and noncombustibles, the process comprising the steps of:

(a) combusting a portion of the fuel with an oxidant in a precombustion zone to form a preheated oxidant;

(b) tangentially introducing the preheated oxidant into a primary combustion zone having a peripheral wall;

(c) introducing the remainder of the fuel into the primary combustion zone;

(d) independently regulating the input velocities and mass flow rates of the oxidant and the fuel so that (i) the fuel is combusted in the presence of the preheated oxidant in the primary combustion zone under substoichiometric conditions to form liquid slag and gaseous combustion products comprising sulfur and oxides of carbon, (ii) substantially all of the carbon content of the fuel is converted to oxides of carbon before the gaseous combustion products leave the primary combustion zone, (iii) the temperature within the primary combustion zone is maintained above the ash-fusion temperature of the fuel, and (iv) a majority of the noncombustibles are driven as liquid slag to the peripheral wall of the primary combustion zone to form treated gaseous combustion products that leave the primary combustion zone and have a temperature above the ash fusion temperature of the fuel and a noncombustible content that is reduced with respect to the noncombustible content of the fuel;

(e) removing liquid slag from the primary combustion zone;

(f) passing treated gaseous combustion products exiting the primary combustion zone through a transition zone;

(g) introducing a sulfur sorbent into the transition zone and rapidly mixing the sorbent with the treated gaseous combustion products to enable a substantial reduction in the sulfur content of the treated gaseous combustion products;

(h) introducing additional oxidant into the transition zone and rapidly mixing the additional oxidant with the treated gaseous combustion products to reduce the temperature of the treated gaseous combustion products to below the ash-fusion temperature of the fuel, the amount of additional oxidant being sufficient to raise the stoichiometry of the process to at least 1;

(i) forming a substantially solids-free working fluid by passing the treated gaseous combustion products exiting the transition zone into a secondary combustion zone for (i) substantially completing the oxidation of the oxides of carbon in the treated gaseous combustion products with oxidant added to the transition zone, (ii) reducing the sulfur content of the treated gaseous combustion products with the sorbent, and (iii) removing any solid and liquid particles entrained in the treated gaseous combustion products, including any sorbent present, before the treated gaseous combustion products exit the secondary combustion zone; and (j) passing the substantially solids-free working fluid to the gas turbine.

48. A process for generating a purified working fluid suitable for use in an end-use equipment by combusting a particulate carbonaceous fuel comprising carbon, sulfur, and noncombustibles, the process comprising the steps of:

(a) introducing the fuel into a primary combustion zone having a peripheral wall;

(b) introducing an oxidant into the primary combustion zone;

(c) combusting the fuel in the presence of the oxidant in the primary combustion zone under substoichiometric conditions at a temperature above the ash-fusion temperature of the fuel to form liquid slag and gaseous combustion products comprising sulfur and oxides of carbon, wherein substantially all of the carbon content of the fuel is converted to oxides of carbon before the gaseous combustion products leave the primary combustion zone and before the fuel particles impinge on the wall, and substantially all of the liquid slag is driven to the peripheral wall of the primary combustion zone;

(d) removing the liquid slag from the primary combustion zone;

(e) introducing a sulfur sorbent and additional oxidant into the gaseous combustion products exiting the primary combustion zone and rapidly mixing the sorbent and additional oxidant with the gaseous combustion products to enable a substantial reduction in the sulfur content of the gaseous combustion products and to reduce the temperature of the gaseous combustion products to below the ash-fusion temperature of the fuel, the amount of additional oxidant being sufficient to raise the stoichiometry of the process to at least about 1;

(f) forming a working fluid by passing the gaseous combustion products exiting the primary combustion zone into a secondary combustion zone for (i) substantially completing the oxidation of the oxides of carbon in the gaseous combustion products with the additional oxidant, (ii) reducing the sulfur content of the gaseous combustion products with the sorbent, and (iii) removing solid and liquid particles entrained in the gaseous combustion products before the gaseous combustion products exit the secondary combustion zone; and (g) conducting the working fluid to the end-use equipment.

49. The process of claim 38 wherein the sorbent is introduced into the gaseous combustion products downstream from where the additional oxidant is introduced into the gaseous combustion products.

50. The process of claim 38 wherein the sorbent and the additional oxidant are introduced into the gaseous combustion products at approximately the same location.

51. The process of claim 38, wherein the gaseous combustion products further comprise alkali vapor and the sorbent reduces the sulfur and alkali vapor content of the gaseous combustion products.

52. The process of claim 38, 47, or 48 wherein the working fluid has a temperature that is compatible with the end-use equipment.

53. An apparatus for generating a working fluid suitable for use in end-use equipment by combusting a carbonaceous fuel comprising carbon, sulfur, and noncombustibles, the apparatus comprising:

(a) a primary combustor comprising a head end, an exit opposed to the head end, and a wall connecting the head and exit ends;

(b) fuel introduction means in communication with the primary combustor for introducing the fuel into the primary combustor;

(c) oxidant introduction means in fluid communication with the primary combustor between the head end and exit end for introducing the oxidant into the primary combustor;

(d) means for independently regulating the input velocities and mass flow rates of the oxidant in the fuel so that (i) the fuel is combusted in the presence of the oxidant in the primary combustor under substoichiometric conditions to form liquid slag and gaseous combustion products comprising sulfur and oxides of carbon, (ii) substantially all of the carbon content of the fuel is converted to oxides of carbon before the gaseous combustion products leave the primary combustor, (iii) the temperature within the primary combustor is maintained above the ash-fusion temperature of the fuel, and (iv) the majority of the noncombustibles are driven as liquid slag to the wall of the primary combustor;

(e) slag removal means in fluid communication with the primary combustor for removing liquid slag from the primary combustor;

(f) transition means in fluid communication with the primary combustor, the transition zone being adapted to receive gaseous combustion products from the primary combustor;

(g) sorbent introduction means in communication with the transition means for introducing a sulfur sorbent into the transition means for rapid mixing with the gaseous combustion products;

(h) additional oxidant introduction means in fluid communication with the transition means, the additional oxidant introduction means and the transition zone being adapted so that the additional oxidant (i) is rapidly mixed with the gaseous combustion products to reduce the temperature of the gaseous combination products to a temperature suitable for use in the end use equipment, and (ii) for substantially completing combusting the oxides of carbon in the gaseous combustion products;

(i) a secondary combustor in fluid communication with the transition means for (i) receiving gaseous combustion products exiting the transition means, (ii) substantially completely oxidizing the oxides of carbon in the gaseous combustion products with the additional oxidant added to the transition means, (iii) substantially reducing the sulfur content of the gaseous combustion products with the sorbent, and (iv) substantially removing any solid and liquid particles entrained in the gaseous combustion products to from a working fluid; and (j) means to contact the working fluid to the end-use equipment.

54. The apparatus of claim 53 wherein the sorbent introduction means is adapted to introduce the sorbent into the gaseous combustion products downstream from where the additional oxidant introduction means is adapted to introduce additional oxidant into the gaseous combustion products.

55. The apparatus of claim 53 wherein the sorbent introduction means and the additional oxidant introduction means form a single means adapted to simultaneously introduce the sorbent and the additional oxidant into the gaseous products.

56. The apparatus of claim 53 wherein the apparatus is capable of reducing the sulfur level in the gaseous combustion products exiting the secondary combustion zone by 70 to 90 percent.

57. The apparatus of claim 53 wherein the means for independently regulating comprises means for maintaining the oxidant mass flow rate at a stoichiometry of about 70 to about 90 percent in the primary combustor.

58. The apparatus of claim 53 wherein the oxidant introduction means comprises a precombustor adapted to combust a portion of the carbonaceous fuel with oxidant to form a preheated oxidant and to introduce the preheated oxidant into the primary combustor.

59. The apparatus of claim 53 wherein the secondary combustor is further adapted to cyclonically separate substantially all of the solid particles from the gaseous combustion products.

60. The apparatus of claim 53 wherein the secondary combustor is adapted so that the gaseous combustion products exiting the secondary combustor have a temperature that is compatible with the end-use equipment.

61. The apparatus of claim 53 wherein the apparatus is adapted to combust the carbonaceous fuel at a pressure above 1 atmosphere.

62. The apparatus of claim 53 wherein the transition means is adapted to tangentially introduce the gaseous combustion products into the secondary combustor.

63. The apparatus of claim 53 wherein the oxidant introduction means is adapted to tangentially inject oxidant that is preheated into the primary combustor along the wall and between the head end and the exit end, the oxidant introduction means being positioned in a manner such that a flow of the preheated oxidant is split with a portion proceeding towards the head end and a portion proceeding towards the exit end.

64. The apparatus of claim 53 wherein the primary combustor is adapted to be operated under liquid slag-coated wet wall conditions.

65. An apparatus for combusting a fuel comprising carbon, sulfur, and noncombustibles for use in a gas turbine, the apparatus comprising:

(a) a precombustor for combusting a portion of the fuel with an oxidant to form a preheated oxidant;

(b) a primary combustor comprising a head end, an exit end, and a peripheral wall connecting the head and exit ends, the primary combustor being in fluid communication with the precombustor and adapted to combust the remainder of the fuel in the presence of the preheated oxidant under substoichiometric conditions to form liquid slag and gaseous combustion products comprising sulfur and oxides of carbon, wherein substantially all the carbon content of the fuel is converted to oxides of carbon before the gaseous combustion products leave the primary combustor, and substantially all of the liquid slag is driven to the wall of the primary combustor;

(c) oxidant introduction means for introducing the preheated oxidant into the primary combustor along the wall and between the head end and the exit end; the oxidant introduction means being in receptive fluid communication with the precombustor and discharging fluid communication with the primary combustor;

(d) fuel introduction means for introducing the carbonaceous fuel into the primary combustor, the fuel introduction means extending from near the center of the head end into the primary combustor to a point between the head end and the exit end;

(e) slag removal means in fluid communication with the primary combustor for removing liquid slag from the primary combustor;

(f) transition means in fluid communication with the primary combustor, the transition means being adapted to receive the gaseous combustion products from the primary combustor;

(g) sorbent introduction means in communication with the transition means for introducing a sorbent into the transition means, the sorbent introduction means and the transition means being adapted so that the sorbent is rapidly mixed with the gaseous combustion products;

(h) additional oxidant introduction means in fluid communication with the transition means for introducing additional oxidant into the transition means, the additional oxidant introduction means and the transition means being adapted so that the additional oxidant (i) is rapidly mixed with gaseous combustion products to reduce the temperature of the gaseous combustion products and (ii) is sufficient to enable the oxides of carbon in the gaseous combustion products to be substantially completely oxidized;

(i) a secondary combustor in fluid communication with the transition means, the secondary combustor being adapted to form a working fluid from the gaseous combustion products by (i) receiving the gaseous combustion products exiting the transition means, (ii) substantially completing oxidation of the oxides of carbon in the gaseous combustion products, (iii) substantially reducing the sulfur content of the gaseous combustion products, and (iv) substantially removing any solid and liquid particles entrained in the gaseous combustion products before the gaseous combustion products exit the secondary combustor; and (j) means to conduct the working fluid to the end-use apparatus.

66. The apparatus of claim 9 including means for injecting a gettering agents for sulfur oxides downstream of the exit end of the primary combustor.

67. The process of claim 38 wherein the sorbent is introduced into the transition zone at a location upstream of where the additional oxidant is introduced into the transition zone.

68. The process of claim 38 wherein the sorbent and the additional oxidant are introduced into the transition zone at the same location.

69. The process of claim 38 wherein sufficient additional oxidant is introduced into the transition zone to reduce the temperature of the gaseous combustion products to a temperature no more than about 200° F.

70. The process of claim 38 wherein sufficient oxidant is introduced into the transition zone to reduce the temperature of the gaseous combustion products to form slag droplets.

71. A process for generating a working fluid suitable for use in heat-utilization equipment such as gas turbines and the like, by combusting a carbonaceous fuel comprising carbon, sulfur, and non-combustibles in a primary combustion zone to form gaseous combustion products containing sulfur bearing constituents, wherein the fuel input mass-flow rate relative to an oxidizer input mass-flow rate is regulated to maintain substoichiometric combustion conditions at temperatures above the ash-fusion temperature of the fuel, such that most of the carbon is converted to oxides of carbon and most of the non-combustibles are deposited as liquid slag, the steps of:

(a) separating liquid slag from gaseous combustion products, thereby providing treated gaseous combustion products relatively free of ash for delivery to an associated heat-utilization equipment, the gaseous combustion products containing sulfur-bearing constituents;

(b) passing the gaseous combustion products into a secondary combustion zone;

(c) introducing additional oxidant and a sorbent for sulfur into the gaseous combustion products substantially as the gaseous combustion products pass into the secondary combustion zone with the mass-flow rate of the additional oxidant being sufficient to raise the overall stoichiometry of the process to at least about 1 and reduce the temperature of the gaseous combustion products to below the ash-fusion temperature;

(d) further combusting the gaseous combustion products while reacting the sorbent with sulfur-bearing constituents of the gaseous combustion products thereby to reduce substantially the concentration of sulfur compounds in the gaseous combustion products;

(e) separating solids, including spent and partially-spent sorbent, from the gaseous combustion products to form a thermal-energy carrying working fluid substantially free of particulate solids suitable for use in the heat-utilization equipment; and (f) thereafter conducting the working fluid to the associated heat-utilization equipment.

* * * * *